United States Patent [19]

Noble et al.

[11] Patent Number: 4,834,370

[45] Date of Patent: May 30, 1989

[54] METHOD OF OPTIMIZING THE POWER ZONE OF A BAT

[75] Inventors: Marion L. Noble, Manhattan, Kans.; John S. Eck, Toledo, Ohio

[73] Assignee: Kansas State University Research Foundation, Manhattan, Kans.

[21] Appl. No.: 134,205

[22] Filed: Dec. 17, 1987

Related U.S. Application Data

[63] Continuation-in-part of Ser. No. 758,314, Jul. 23, 1985, Pat. No. 4,746,117.

[51] Int. Cl.[4] ..... A63B 59/06

[52] U.S. Cl. ..... 273/72 A

[58] Field of Search ..... 273/72 A, 72 R

[56] References Cited

U.S. PATENT DOCUMENTS

| | | | |
|---|---|---|---|
| 1,026,990 | 5/1912 | Matson | 273/67 R |
| 1,499,128 | 6/1924 | Shroyer, Jr. | 273/67 R |
| 2,967,710 | 1/1961 | Carlson | 273/72 R |
| 3,116,926 | 1/1964 | Owen et al. | 273/72 A |
| 3,479,030 | 11/1969 | Merola | 273/72 A |
| 3,801,098 | 4/1974 | Gildemeister | 273/72 A |
| 3,963,239 | 6/1976 | Fujii | 273/72 A |
| 3,972,528 | 8/1976 | McCracken | 273/67 R |

OTHER PUBLICATIONS

Bryant et al., Research Quarterly, 48:505–510 (1977).

Broncozio, *Sportscience,* Simon and Schuster, N.Y., 1984, pp. 234–241.

Noble and Eck, "Effect of Selected Exterior Bat Loading Conditions on Center of Percussion of an Aluminum Softball Bat", to be published in *Science in Sports and Exercise* in 1985, 23 pages in manuscript.

*Primary Examiner*—Edward M. Coven

*Assistant Examiner*—Gary Jackson

*Attorney, Agent, or Firm*—Tilton, Fallon, Lungmus and Chestnut

[57] ABSTRACT

Tubular baseball bats are provided with optimized power zones by weighting the bats between the impact and the knob end. By adding a specified amount of weight at a location within this weighting region, the sweet spot of the bat, in effect, may be greatly enlarged so that the sweet spot comprises a power zone extending inwardly from the outer end of the bat. The power zone therefore comprises the portion of the bat which travels at maximum velocity as the bat is swung into the ball, and the ball impacts within the power zone effectively transfers less than 10% of the impact impulse to the hands. The hit ball therefore travels faster and further.

2 Claims, 2 Drawing Sheets

FIG. 1
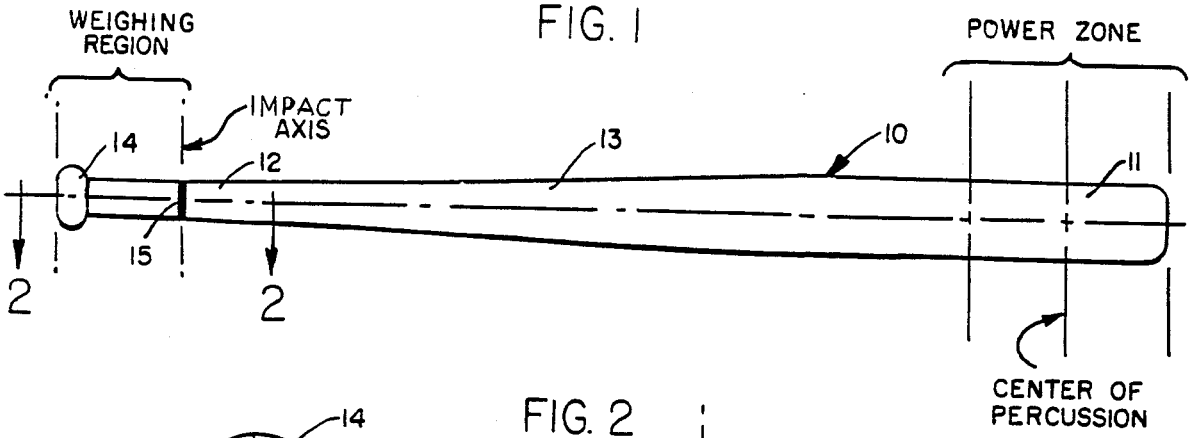
FIG. 2
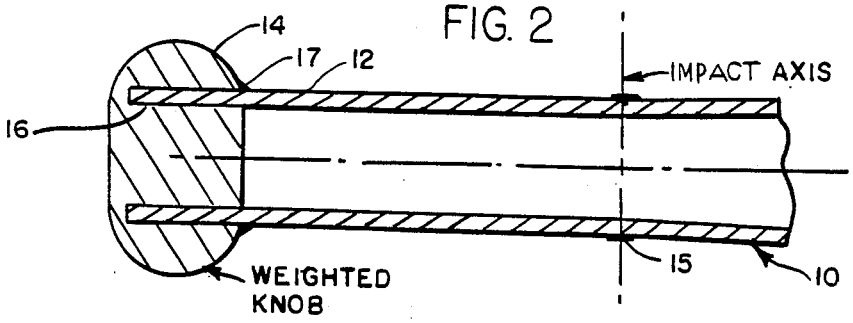
FIG. 3
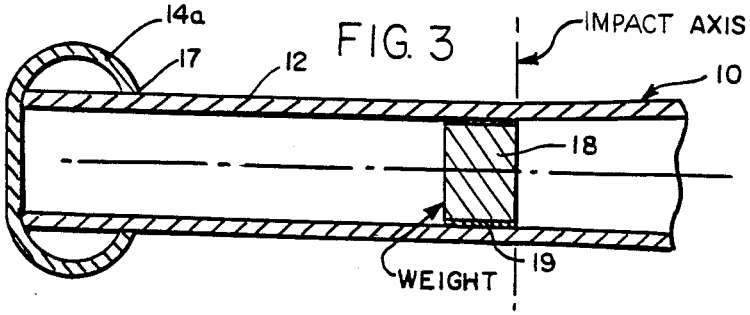
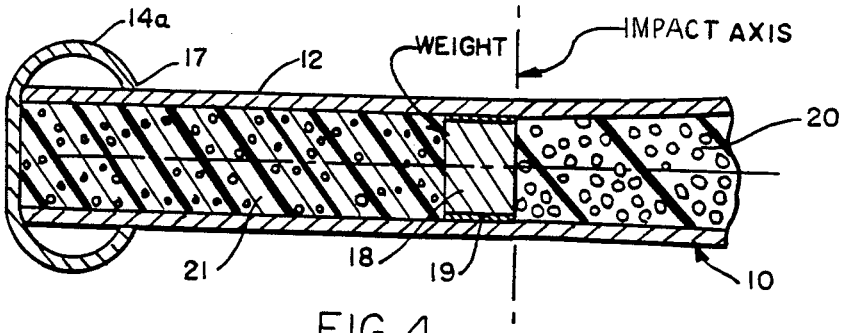
FIG. 4

COP Location as a Function of Knob End Loading

METHOD OF OPTIMIZING THE POWER ZONE OF A BAT

This is a continuation-in-part of application Ser. No. 06/758,314 filed Aug. 23, 1985, now U.S. Pat. No. 4,746,117.

FIELD OF INVENTION, BACKGROUND, AND PRIOR ART

The field of this invention is the design of bats for baseball or softball to improve their ball-hitting effectiveness. More particularly, this invention is concerned with tubular baseball bats with an optimized power zone and a method of optimizing the power zone of a bat.

Historically baseball bats have been formed from solid wood. White ash bats have been preferred for use in profession baseball. In recent years, bats formed from tubular aluminum have been accepted for use in competitive amateur baseball. Such aluminum bats are widely used in Little League, high school, and college for playing softball, and also to a lesser extent for baseball.

Aluminum bats have the advantage over wooden bats of being stronger and much less subject to breakage. Further, aluminum bats have been shown to provide a somewhat larger sweet spot than corresponding wooden bats. See Bryant, et al. *Research Quarterly* (1977) 48: 505–510; and Brancazio, *Sportscience,* 1984, pages 234–241 (Simon & Schuster, N.Y.).

The term "sweet spot refers to the area on the barrel of the bat at which the collision with the ball feels smooth, effortless, and true. As described by Noble and Eck, *Medicine & Science in Sports and Excercise,* (1986) 18: 50–59, the sweet spot is believed to correspond substantially with the "center of percussion," which is defined in mechanics for a rotating object as the point at which an applied impulse creates no reaction at the pivot point, or impact axis.

The tests reported by Bryant et al. (cited above) indicated that the center of percussion of a wooden bat is substnatially confined to a very narrow point or zone. With hollow aluminum bats, the tests appeared to indicate that the sweet spot extended over a wide area of perhaps 1–2 inches. Bryant et al. suggested that the enlarged sweet spot may result from the peripheral distribution of the bat weight.

Prior patents relating to tubular metal bats have disclosed a variety of means for improving bat performance. In particular, various means have been disclosed for adding weight to the barrel end portions of the bats. (See, for example, U.S. Pat. Nos. 1,499,128, 3,116,926, and 3,963,239.) Other means for improving the performance of foam-filled tubular metal bats are described in U.S. Pat. Nos. 3,801,098 and 3,972,528. None of these patents, however, relates specifically to means for enlarging the sweet spot or center of percussion of the bats or for changing its location.

A primary disadvantage of weighting a tubular metal bat at its barrel end is the resulting increase in swing resistance. The amount of effort required to swing the bat at a given velocity is appreciably increased by barrel end weighting. Consequently, since the velocity of the hit ball and the distance it travels are directly related to the mass and velocity of the bat at the point of impact, adding weight to the barrel end of the bat can result in reduced hitting power for the batter.

Brancazio (cited above), at page 234, points out the impact velocity cannot in practice be maximized hitting the ball at the extreme outer end of the bat. In this connection, the reference states that "when the ball is hit at the very end of the bat, the ball does not seem to travel as far, and contact also produces a stinging sensation in the hands." This is because the sweet spot or center of percussion is located inwardly from the barrel end. While the exact center of percussion depends on the location of the pivot point, the extent of pivot point movement is not usually very great. As summarized by Brancazio (page 237): "For most baseball bats held in the conventional way, the center of percussion is located about 6 to 8 inches from the fat end of the bat.

An early patent relating to solid wooden bats proposed weighting of the knob end of the bat (U.S. Pat. No. 1,026,990 of 1912). The purpose of the added weight was "to counteract the shock due to the impact and to preserve the equipoise of the bat" (col. 1, lines 10–12.) The patent does not describe any other benefit, and, as far as it is known, weighted end caps or knobs have not been applied to hollow metal bats.

SUMMARY OF INVENTION

On the basis of mathematical analysis and experimental verification, it has been found that the hitting effectiveness of tubular metal bats can be greatly improved by adding weight to the bat between the inner end of the bat and the impact axis. Within the region, sufficient weight can be added to appreciably enlarge the center of percussion, or, more specifically, the power zone can be displaced so that it substantially coincides with the outer end of the bat. This results in a bat where the outer end portion of the bat which is the portion moving with maximum velocity comprises a greatly enlarged "sweet spot", providing an optimized power zone. Moreover, the addition of weight between the inner end of the bat and the impact axis does not objectionably increase the swing resistance of the bat.

The mathematical and mechanical principals underlying the design of the bat of this invention have not heretofore been understood or appreciated. The prior art was proceeding in the wrong direction to obtain improved hitting efficiency by adding weight to hollow metal bats at their barrel ends. While the experiments leading to the present invention demonstrated that some enlargement of the sweet spot can be obtained by such barrel end weighting, the extent of such enlargement is considerably less than by adding the amount of weight between the inner end of the bat and the impact axis. Further, as pointed out previously, weighting of the barrel end greatly increases the swing resistance of the bat. "Another limitation with weighting of the barrel end is that the "sweet spot" referred to herein as the "power zone" cannot be displaced to the very end portion of the bat. To maximize the velocity of the hitting area, it would be desirable to have the outer boundary of the power zone coincide with the outer end of the bat, and to extend inwardly therefrom to maximize distance along the barrel portion of the bat. The present invention is believed to be the first design to achieve the result.

THE DRAWING

Illustrative embodiments of bats designed in accordance with the principals of this invention are shown in the accompanying drawings, wherein FIG. 1 is a plan view of the exterior of a metal tubular bat which has been labeled to designate the weighting region, the impact axis, the power zone, and the center of percussion.

FIG. 2 is a sectional view taken on line 2—2 of FIG. 1 illustrating the internal construction of the bat and particularly the construction of the weighted knob.

FIG. 3 is a cross-sectional view showing a modified design for the hand-grip and knob-end portion of a hollow tubular bat wherein a weighting plug is inserted adjacent the impact axis.

FIG. 4 is a cross-sectional view of another modified design for the hand-grip and knob-end portion of a foam-filled tubular metal bat which has been weighted in accordance with the present invention.

DETAILED DESCRIPTION

Figure 5:
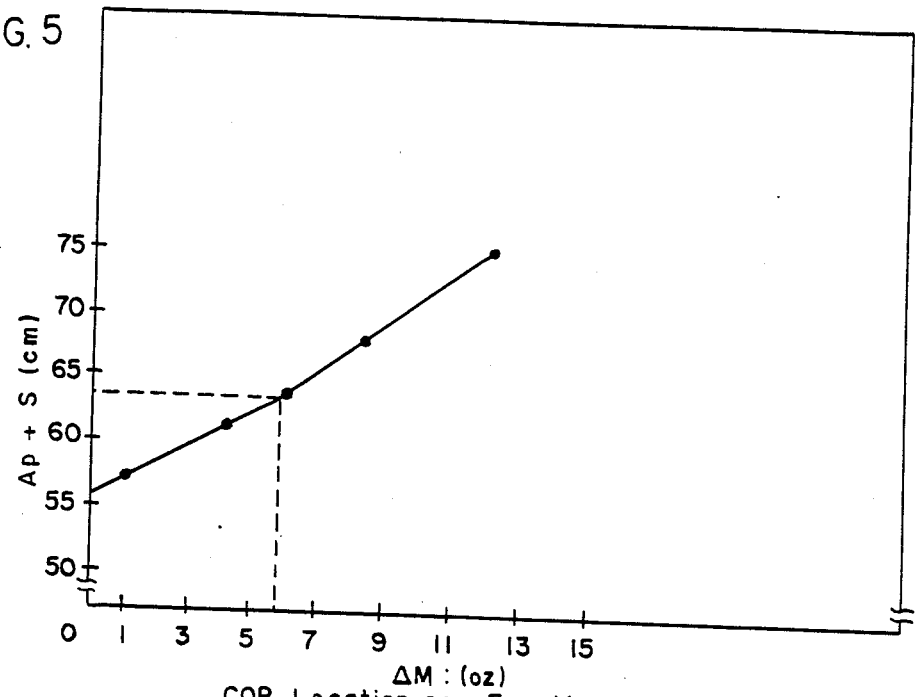
FIGS. 5 and 6 are diagrams which may be used in the determination of the weight to be added to a bat for power zone optimization.

Tubular bats for use in practicing the present invention may be formed of the same materials and made by the same manufacturing procedures as previously employed. For example, bats may be made from aluminum or magnesium, or alloys thereof. The bats may be formed from tube stock by drawing and machining operations, or by die-casting. The knob is then applied to close the inner end and to provide for hand retention. The knob is securely attached such as by welding. Also, if desired, the hollow metal bats may be filled with a foam plastic such as polyurethane. The bats will be constructed in accordance with applicable standards of length, weight, etc. For example, softball bats are specified to have a maximum weight of 38 ounces and a maximum length of 34 inches.

In general, therefore, the improved design of the present invention is applicable to bats for playing softball or baseball which are formed of a generally cylindrical metal tube providing a large diameter barrel portion extending inwardly from its outer end, a smaller diameter grip portion adjacent to its inner end, and a connecting portion extending therebetween. The bat will have an inner end terminating in a hand-retaining knob, and will have a normal impact axis located so that the batter's hands can be placed together on the grip portion with the impact axis beneath the first knuckle on the top hand. These standard features are illustrated by reference to FIG. 1 of the drawing.

The bat of FIG. 1 is designated generally by the number 10. It includes a barrel portion 11, a handgrip portion 12, an intermediate portion 13, and a knob 14. The location of the impact axis is indicated, which is the plane including the first knucle of the batter's top hand when holding the grip portion 12. To more precisely define the location of the impact axis, the exterior of the bat may be marked with an annular stripe 15 or other indicia. Sufficient space will be provided between the stripe 15 and the knob 14 to accommodate batters' hands of varying widths.

For the purpose of the present invention, the region of the bat between the impact axis and the inner or knob end of the bat inclusively is designated as the "weighting region." Specifically, this is the region in which the bat is to be loaded with additional weight. In accordance with the present invention, the weighting means is integrated with the bat in the weighting region. The weighting means should add sufficient weight to the bat to provide a power zone of enlarged longitudinal width and also, preferably, an enlarged power zone having its outer boundary displaced toward the barrel end of the bat so that it substantially coincides with the outer end of the bat. This preferred location is illustrated in FIG. 1 and is referred to by the label "power zone."

In FIG. 1, the theoretical center of percussion is also indicated as a plane transverse to the longitudinal axis of the bat. It is impossible to add sufficient weight between the impact axis and the inner end of the bat to displace the theoretical center of percussion further out toward the extreme barrel end of the bat then illustrated in FIG. 1. However, such "overweighting" of the bat would have the result that the outer part of the power zone, in effect, would extend off of the end of the bat. This would result in a loss of the effective width of the power zone, and is therefore undesirable for optimization of the power zone. The preferred construction is as shown wherein the outer boundary of the power zone reaches the end of the bat but does not extend substantially therebeyond.

For the purposes of the present invention, the "power zone" is defined as the area on the barrel portion of the bat where the reaction impulse at the swing axis is less than 10% of the ball impact impulse on the barrel portion. Using the mathematical formula and the procudure subsequently to be described, this is a readily determinable value. For practical purposes, the "power source" as thus defined represents an effective enlargement of the center of percussion or sweet spot. When the ball is hit anywhere within the power zone, less than 10% of the impact impulse is lost due to the mechanical reaction on the hands. Further, the impact momentum is itself maximized by locating the power zone on the extreme outer end of the bat which is traveling at the highest velocity as the bat is swung into the ball.

In FIGS. 2, 3 and 4, different weighting means are illustrated which can be employed for achieving the results of the present invention in which the power zone is greatly enlarged and localized in the outer portion of the barrel end of the bat. Looking first at FIG. 2, the knob 14 comprises a solid metal knob which is provided with an angular groove 16 for receiving the inner end of the handgrip portion 12. The knob 14 may be attached to the handgrip portion 12 by welding as indicated at 17. The knob 14 may be formed of the same metal as the tubular bat 10, such as aluminum, or may be formed of a heavier metal or metal alloy. Heretofore, it has been the practice to provide hollow metal bats with hollow endcaps, such as the ones illustrated in FIGS. 3 and 4.

Another modification of the weighting means is shown in FIG. 3. In that design, the knob 14A comprises a hollow cap member which receives and is weldably connected at 17 to the handgrip portion 12, as shown. This embodment, the weighting means comprises a solid metal plug 18 which is received within the interior of the handgrip portion 12. The weighting member 18 should be located between the impact axis and the inner end of the bat. To obtain the desired improvement in the size and location of the power zone with minimized effect on swing resistance, the weighting plug 18 can be located as shown in FIG. 3. This is the preferred position in which the outer end of the plug 18 is located substantially at the impact axis and extends therefrom toward the inner end of the bat.

Plug 18 can be made of the required length to add sufficient weight to displace the power zone so that its outer boundary corresponds with the outer end of the barrel portion, as described above, and preferably formed of a denser substance than the metal forming the bat 10, such as lead, zinc, or steel. Means should be provided for retaining the plug 18 in fixed location. In the illustration given, plug 18 is adhesively bonded to the inner wall of the grip portion 12 as indicated at 19. Any suitable metal bonding adhesive can be employed for this purpose. Location of added weight beyond the impact axis, such as in intermediate portion 13 of the bat, has little effect on the extent or location of the power zone.

A still further design embodiment is illustrated in FIG. 4. The metal components of the FIG. 4 embodiment are the same as those of FIG. 3, hollow end cap 14A being attached to the grip portion 12 a metal plug 18 being adhesively attached adjacent to the impact axis as previously described. In this embodiment however, the interior of the bat 10 is filled with a foam plastic, such as a polyurethane foam composition. To provide added weight in the region between the impact axis and the inner end of the bat, density of the foam composition may be increased in that region. For example, the interior of the bat may be first filled with a relatively low density foam up to the location of the impact axis, and then after insertion of the weight 18, which can serve as a divider, the remaining portion of the bat can be filled with a foam of relatively higher density.

As shown in FIG. 4, the foam 20 is the low density foam, while the foam 21 is the high density foam. The density of the foam may be varied, increasing or decreasing the cell size, such as by using a lesser amount of blowing agent to achieve a smaller cell size and greater density foam. Alternatively or additionally, weighting agents can be incorporated in the foam such as metal powders or compounds of heavy metals in particulate form which can be mixed with foam composition prior to introduction in the bats.

The method of the present invention comprises adding weight to the bat between the inner end of the bat and the impact axis. This method for optimizing the power zone of a bat is illustrated in the following examples.

EXAMPLES

In order to optimize the power zone of a bat the following parameters of the bat are first determined:

1. Mass (M)
2. Length (L)
3. Distance from impact axis to center of mass (S)
4. Period of oscillation about the impact axis (16.8 cm from the knob end for adult males) (T)
5. Distance from axis to center of percussion:

$$a_p + s = \frac{T^2 g}{4\pi^2}$$

where $T$ is the period of oscillation and $g$ is the acceleration due to gravity 6. Moment of inertia about the impact axis:

$$I_o = \frac{T^2 mgs}{4\pi^2}$$

where $s$ is the rotation radius and $m$ is the mass

7. Value of Ap+S for power zone optimization:

$$a_p + s = \frac{L - 16.8\text{ cm}}{1.1} \quad \text{where } L \text{ is bat length in cm}$$

Here, 16.8 cm is the distance from the knob end to the impact axis. This value is appropriate only for adult males. For women and children, a smaller value is needed. This value is obtained by having the hitter hold the bat in the manner used for hitting. Then, find the distance from the knob end to the first knuckle of the top hand. This value is then used in the equation.

In order to determine the appropriate location for a given load (ΔM) or the appropriate load for a given location to optimize the power zone of the bat, the following relationships must be considered.

When adding a mass, ΔM, to the interior of a bat with a moment of inertia about the impact axis, $I_o$, and a radius of rotation, s, at a distance from the center-of-mass, X, the moment of inertia of the loaded bat is given by:

$$I_o = I_o + \Delta M(s - X)^2 \tag{1}$$

the mass of the loaded bat is given by:

$$M' = M + \Delta M \tag{2}$$

where M′ is the total mass of the loaded bat, M is the mass of the unloaded bat and M is the added mass, the radius of rotation of the loaded bat is:

$$s' = \left(s - \frac{\Delta M X}{M + \Delta M}\right) \tag{3}$$

where s is the distance of the center of mass of the loaded bat from the impact axis and the other parameters are defined as above, and finally the distance from the impact axis to the COP of the loaded bat is:

$$a'_p + s' = \frac{I_o}{M'S'} \tag{4}$$

where $a_p + s'$ is the distance of the center of percussion from the impact axis for the loaded bat.

The power zone is defined as the region where the reaction impulse at the impact axis is ≦0.1 of the applied impulse. This region lies between $$0.9(a_p + s) \text{ and } 1.1(a_p + s) \tag{5}$$

In order to clarify the manner in which the appropriate load is determined for knob end loading to optimize the power zone, a conventional aluminum bat was selected for use as an example. This bat was initially tested for the following parameters:

1. Mass=741 g (26.1 oz.)
2. Length=86.7 cm (34.1 in.)
3. $a_p + s = 55.5$ cm
4. $I_o = 1.543 \times 10^6$ g.cm$^2$
5. s=37.5 cm For the power zone to be optimized, it must be placed such that:

$$a_p' + s' = \frac{86.7\text{ cm} - 16.8\text{ cm}}{1.1} = 63.55\text{ cm}$$

Equation 4 gives the resultant value for $a'_p+s'$ for a given load added. However, before this equation can be solved, the values for $I'_o$, $M'$ and $s'$ must be determined. These values can be easily calculated from equations 1, 2, and 3, respectively. The most efficient manner in which to proceed is to solve each of these equations with mass added in constant increments and develop a graph showing the relationship between $\Delta M$ and $a'_p+s'$. FIG. 5 shows this relationship for the sample bat. Sample calculations for $\Delta M=1$ oz. (28.41 g) are:

1. For new moment of inertia:

$$\begin{aligned} I_o' &= I_o + M(s-x)^2 \\ &= 1.543 + 28.41(37.5-54.3)^2 \\ &= 1.551 \times 10^6 \text{ g}\cdot\text{cm}^2 \end{aligned}$$

2. For the new mass:

$$M' = M + \Delta M$$

$$M' = 741 \text{ g} + 28.4 \text{ g} = 769.4 \text{ g}$$

3. $$s' = s - \frac{\Delta MX}{M+\Delta M} = 37.5 \text{ cm} - \frac{(28.4 \text{ g})(54.3 \text{ cm})}{741 \text{ g} + 28.4 \text{ g}} = 35.5 \text{ cm}$$

4. $$a_p' + s' = \frac{I_o'}{M'S'} = \frac{1.551 \times 10^6 \text{ g}\cdot\text{cm}^2}{(769.4 \text{ g})(35.5 \text{ cm})} = 56.8$$

Values for $a'_p$ and $s'$ were similarly obtained for knob end loading of various amounts and used to construct FIG. 5. It is now possible to determine the point on the curve corresponding to the desired value of $a_p+s$ and to find the corresponding $\Delta M$ values, which are 63.55 cm and 5.8 ounces (165 g), respectively, This value can then be verified by solving equations 1 through 4 with 165 g entered into the equation. Application of 165 g yields a value for $a'_p+s'$ of 63.55 cm. If the desired COP is slightly different from the derived value, it can easily be corrected by adding or removing a few grams from or to the loaded amount and recalibrating.

Another occasion wherein the power zone can be optimized is when the loaded amount is held constant, and the load placement needs to be determined. To accomplish this, we proceed as before, using equations 1 through 4 to generate the data to construct a graph of the location of the COP and the load location for a given amount of additional load. For this example, the value of 6.5 ounces (185 g) is used as the load amount, and the load location is expressed as distance of the added mass from the center of mass of the bat. For example, for loading at the knob end, X=54.3 cm:

$$\begin{aligned} I_o' &= I_o + \Delta M(s-X) \\ &= 1.543 \times 10^6 \text{ g}\cdot\text{cm}^2 + 185\text{g}(37.5\text{cm} - 54.3\text{cm}) \\ &= 1.595 \times 10^6 \text{ g}\cdot\text{cm}^2 \\ M' &= 741 \text{ g} + 185 \text{ g} = 926 \text{ g} \\ s' &= 37.5 \text{ cm} - \frac{185 \text{ g}}{926 \text{ g}} X \\ &= 37.5 \text{ cm} - .1998\, X = 26.65 \text{ cm} \end{aligned}$$

$$a_p' + s' = \frac{I_o'}{M's'} = \frac{1.595 \times 10^6 \text{ g}\cdot\text{cm}^2}{(926 \text{ g})(26.65 \text{ cm})} = 64.63$$

Figure 6:
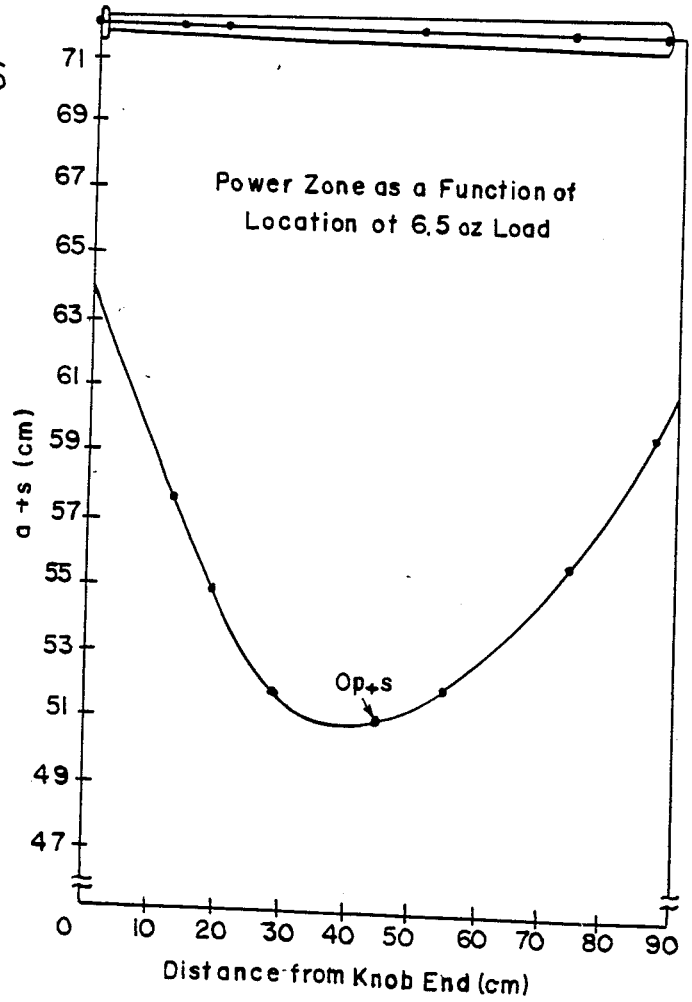

The value of X is then systematically changed and these values calculated for each value of X. This data is then used to construct the plot of $a_p+s$ as a function of load location (see FIG. 6). To determine the correct load location, enter the graph at the horizontal level of the desired $a_p+s$ (63.55 cm in this case), find the curve at that level, and move vertically downward to the horizontal scale. In this case, the estimated location is 1 cm from the knob end. Again, this value can be verified by solving the equations for the appropriate values. In this case, the calculated value for $a'_p+s'$ when 6.5 ounces is added at a point 1 cm from the knob end is 63.91 cm. Thus, the location of the COP will be 4 mm too far toward the barrel end if the load is placed 1 cm from the knob end. The load location, X, can be changed slightly and the value of $a'_p+s'$ calculated repeatedly until the precise location desired is obtained.

If a different load amount is to be used, a different curve must be generated.

As a second example, assume we desire to optimize each of the two bats described below by placing the entire load at the knob end.

| Bat #1 | |
|---|---|
| Mass = | 786 g |
| Length = | 86.1 cm |
| $a_p + s$ = | 52.3 cm |
| $I_o$ = | $1.370 \times 10^6$ g · cm$^2$ |
| s = | 33.3 cm |

To optimize this bat then:

$$a'_p + s' = \frac{86.1 \text{ cm} - 16.8 \text{ cm}}{1.1} = 63 \text{ cm}$$

The load required to achieve this is 207 g.

| Bat #2 | |
|---|---|
| Mass = | 799 g |
| Length = | 86.3 cm |
| $a_p + s$ = | 52.1 cm |
| $I_o$ = | $1.370 \times 10^6$ g · cm$^2$ |
| s = | 32.9 cm |

To optimize this bat:

$$a_p' + s' = \frac{86.3 \text{ cm} - 16.8 \text{ cm}}{1.1} = 63.2 \text{ cm}$$

Load required=217 g

Of course, it we add 185 g and determine where to place the load to optimize the power zone, there is no solution because more than that is required even if all the mass is at the knob end.

In practicing the invention in the manner described in the foregoing examples, it is not essential that the tubular bat be formed of metal. The only requirement is that the hollow tube comprising the bat be formed of a material of sufficient strength to perform as a bat. Such materials can be chosen from, but are not necessarily limited to, metals, graphite, fiberglass, plastics, or composites therefore. For example, the bat may be made of a graphite reinforced thermoplastic, such as polycarbonate/-polybutylene terephthalate blend. Such bats may be formed in a molding machine around a steel core pin, and their hollow shells filled with cellular urethane foam. The bats will be weighted in accordance with the present invention for optimizing the power zone, as previously described.

We claim:

1. A method of optimizing the power zone or center of percussion of a bat by adding a weight to a bat between the inner end of the bat and the impact axis, the specific location of the weight determined by the steps comprising:

determining the impact axis, O, when adding a mass, ΔM, to the interior of a bat with a moment of inertia about the impact axis, $I_o$, and a radius of rotation, s, at a distance from the center-of-mass, X, the moment of inertia of the loaded bat given by the equation:

$$I'_o = I_o + \Delta M(s-x)^2$$

and the mass of the loaded bat is given by the equation:

$$M' = M + \Delta M$$

where M' is the total mass of the loaded bat, M is the mass of the unloaded bat and ΔM is the added mass, and the radius of rotation of the loaded bat is given by the equation:

$$s' = \left(s - \frac{\Delta MX}{M + \Delta M}\right),$$

where s is the distance of the center of the mass of the loaded bat from the impact axis and therefore, the distance from the impact axis to the center of percussion of the loaded bat is determined by the equation:

$$a'_p + s' = \frac{I_o}{M's'}$$

where $a'_p + s'$ is the distance of the center of percussion from the impact axis for the loaded bat whereby indicating weight should be placed.

2. The method of claim 1 wherein the power zone or center of percussion is defined as the region where the reaction impulse at the axis is ≦0.1 of the applied impulse and this region lies between $$0.9(a_p + s) \text{ and } 1.1(a_p + s)$$

as defined in claim 1.

* * * * *